US009814321B2

(12) United States Patent
Garland

(10) Patent No.: US 9,814,321 B2
(45) Date of Patent: Nov. 14, 2017

(54) CONVERTIBLE FURNITURE

(71) Applicant: American Leather Operations, LLC, Dallas, TX (US)

(72) Inventor: Thomas A. Garland, Palmetto, FL (US)

(73) Assignee: American Leather Operations, LLC, Dallas, TX (US)

( * ) Notice: Subject to any disclaimer, the term of this patent is extended or adjusted under 35 U.S.C. 154(b) by 0 days.

(21) Appl. No.: 15/057,473

(22) Filed: Mar. 1, 2016

(65) Prior Publication Data

US 2017/0251815 A1 Sep. 7, 2017

(51) Int. Cl.
*A47C 17/04* (2006.01)
*A47C 13/00* (2006.01)

(52) U.S. Cl.
CPC ..... *A47C 17/045* (2013.01); *A47C 13/00* (2013.01)

(58) Field of Classification Search
CPC ..... A47C 13/00; A47C 17/045; A47C 17/13; A47C 17/136; A47C 17/138; A47C 17/22
See application file for complete search history.

(56) References Cited

U.S. PATENT DOCUMENTS

| | | | | |
|---|---|---|---|---|
| 134,875 | A | 1/1873 | Fauh | |
| 978,032 | A | 12/1910 | Kindel | |
| 1,408,014 | A | 2/1922 | Luppino | |
| 2,007,988 | A | 7/1935 | Thomas, Jr. | |
| 2,570,401 | A | 10/1951 | Stein | |
| 2,664,145 | A | 12/1953 | Creveling et al. | |
| 2,671,228 | A | 3/1954 | De Maria | |
| 2,740,131 | A | 4/1956 | Vogel et al. | |
| 2,785,415 | A | 3/1957 | Peterson | |
| 2,785,416 | A | 3/1957 | Bebry | |
| 2,804,122 | A * | 8/1957 | Baum | A47B 21/02 108/13 |
| 2,876,461 | A | 3/1959 | Bontempi | |

(Continued)

FOREIGN PATENT DOCUMENTS

| | | |
|---|---|---|
| CA | 953053 | 8/1974 |
| CN | 2043842 | 9/1989 |

(Continued)

OTHER PUBLICATIONS

Cover of HighPoints publication, Tiffany Sleeper, Market Introductions, Apr. 2000, 1 pg.

(Continued)

*Primary Examiner* — Philip Gabler
(74) *Attorney, Agent, or Firm* — Womble Carlyle Sandridge & Rice, LLP

(57) ABSTRACT

Furniture convertible between a seating position and a bed position. The furniture may include a frame including spaced apart arms, a first section having a closed position and an open position, where, in the closed position, the first section is substantially horizontal between the spaced apart arms, and a second section separately moveable from the first section. The second section is movable from a folded position, where the second section is stored substantially within the frame, to an unfolded position, where the second section is unfolded outside of the frame and disposed adjacent to the first section in the closed position, thus forming a horizontal sleeping surface.

21 Claims, 12 Drawing Sheets

(56) References Cited

U.S. PATENT DOCUMENTS

| | | | | |
|---|---|---|---|---|
| 2,911,655 | A | 11/1959 | Pokorny, Jr. | |
| 2,966,205 | A * | 12/1960 | Blaschko | A47C 1/146 297/111 |
| 2,988,757 | A | 6/1961 | Hubbell et al. | |
| 3,011,181 | A | 12/1961 | Dooley | |
| 3,049,724 | A | 8/1962 | Goodman | |
| 3,085,257 | A | 4/1963 | Laemmle | |
| 3,104,913 | A | 9/1963 | Faulkner et al. | |
| 3,121,237 | A | 2/1964 | Brindisi | |
| 3,145,049 | A | 8/1964 | Duke | |
| 3,178,731 | A | 4/1965 | Pokorny, Jr. | |
| 3,179,469 | A | 4/1965 | Heuston | |
| 3,204,255 | A * | 9/1965 | Scholz | A47C 17/045 5/118 |
| 3,319,269 | A | 5/1967 | Maddox | |
| 3,456,268 | A | 7/1969 | Rogers, Jr. | |
| 3,506,984 | A | 4/1970 | Ellis, Jr. et al. | |
| 3,508,283 | A | 4/1970 | Dukellis, et at | |
| 3,589,770 | A | 6/1971 | Kelley | |
| 3,596,984 | A * | 8/1971 | Jones | A47C 17/22 297/105 |
| 3,608,959 | A | 9/1971 | Sarvas | |
| 3,695,690 | A | 10/1972 | Carson | |
| 3,771,178 | A | 11/1973 | Inman | |
| 3,844,612 | A | 10/1974 | Borggren et al. | |
| 3,864,764 | A | 2/1975 | Janusc | |
| 3,908,210 | A | 9/1975 | Alembik | |
| 4,032,999 | A | 7/1977 | Pringle | |
| 4,563,037 | A | 1/1986 | Tiffany | |
| 4,694,514 | A | 9/1987 | Crossett | |
| 4,737,996 | A | 4/1988 | Tiffany | |
| D338,349 | S | 8/1993 | Warnock | |
| 5,320,407 | A | 6/1994 | Tell | |
| D360,311 | S | 7/1995 | Stamberg et al. | |
| D367,566 | S | 3/1996 | Walters, III et al. | |
| 5,626,388 | A | 5/1997 | Haltner | |
| 5,681,090 | A | 10/1997 | St. Thomas | |
| 5,826,939 | A | 10/1998 | Beyer | |
| 5,855,030 | A | 1/1999 | Williams | |
| 5,893,182 | A | 4/1999 | Sutherland et al. | |
| 5,904,401 | A | 5/1999 | Alberda et al. | |
| 6,089,657 | A | 7/2000 | Banno et al. | |
| 6,116,685 | A | 9/2000 | White et al. | |
| 6,293,624 | B1 | 9/2001 | Gaylord et al. | |
| 6,709,054 | B2 | 3/2004 | Riley et al. | |
| 6,796,609 | B2 | 9/2004 | Illulian | |
| D501,331 | S | 2/2005 | Chen | |
| 6,904,628 | B2 | 6/2005 | Murphy et al. | |
| 7,040,700 | B2 | 5/2006 | Duncan et al. | |
| D526,803 | S | 8/2006 | Lee | |
| 7,373,675 | B2 | 5/2008 | Thurow | |
| 7,549,182 | B2 | 6/2009 | Murphy | |
| 7,607,180 | B2 | 10/2009 | Griepentrog | |
| 7,735,914 | B2 * | 6/2010 | Longnecker | A47C 13/00 297/125 |
| 8,011,034 | B2 | 9/2011 | Hoffman et al. | |
| 8,438,676 | B2 * | 5/2013 | Murphy | A47C 3/16 5/28 |
| 8,793,823 | B2 * | 8/2014 | Baugh | A47B 83/04 5/280 |
| 8,893,323 | B2 | 11/2014 | Garland | |
| 8,997,273 | B2 | 4/2015 | Murphy et al. | |
| 9,144,319 | B2 | 9/2015 | Murphy | |
| 9,420,894 | B2 * | 8/2016 | Thurow | A47C 17/16 |
| 2003/0070225 | A1 | 4/2003 | Murphy et al. | |
| 2007/0283491 | A1 | 12/2007 | Murphy | |
| 2009/0235452 | A1 | 9/2009 | Hoffman et al. | |
| 2011/0010846 | A1 | 1/2011 | Murphy | |
| 2011/0010847 | A1 | 1/2011 | Murphy | |
| 2011/0018331 | A1 | 1/2011 | Murphy et al. | |
| 2014/0101846 | A1 | 4/2014 | Garland | |

FOREIGN PATENT DOCUMENTS

| | | |
|---|---|---|
| CN | 2060312 | 8/1990 |
| CN | 2222467 | 3/1996 |
| CN | 1271554 | 11/2000 |
| DE | 3513076 | 10/1986 |
| EP | 645108 | 3/1995 |
| GB | 2127683 | 4/1984 |
| GB | 2150021 | 6/1985 |
| JP | 5091464 | 7/1975 |
| WO | 9015556 | 12/1990 |
| WO | 2013059309 | 4/2013 |

OTHER PUBLICATIONS

Cover of The Philadelphia Inquirer, Home and Design Section, Apr. 21, 2000, 1 pg.

Functional Upholstery Takes Center Stage, Furniture Today, vol. 24, No. 30d, Apr. 9, 2000, 2 pgs.

Home & Garden, Sun-Sentinel, p. 3E, South Florida, Apr. 14, 2000, 1 pg.

Photograph 1, Version 1, sofa shown at trade show in San Francisco, folding center leg and Version 1 front leg actuator, Jan. 2000, 1 pg.

Photograph 10, Versions 1 and 2, inside arm sprint assist, Jan. 2000, 1 pg.

Photograph 11, Versions 1 and 2, inside arm spring assist, Jan. 2000, 1 pg.

Photograph 12, Versions 1 and 2, inside arm spring assist, Jan. 2000, 1 pg.

Photograph 2, Version 1, sofa shown at trade show in San Francisco, sofa partially opened, Jan. 2000, 1 pg.

Photograph 3, Version 1, sofa shown at trade show in San Francisco, sofa completely opened, Jan. 2000, 1 pg.

Photograph 4, Version 1, sofa shown at trade show in San Francisco, tube assembly front pivot offset and extended and folding center leg extended, Jan. 2000, 1 pg.

Photograph 5, Version 1, sofa shown at trade show in San Francisco, folding center leg extended and front wood leg with Version 1 of front leg actuator, Jan. 2000, 1 pg.

Photograph 6, Version 2, sofa shown at trade show in High Point, folding center leg extended and metal tube front leg with Version 2 of front leg actuator, Apr. 2000, 1 pg.

Photograph 7, Version 2, sofa shown at trade show in High Point, metal tube front leg with Version 2 of front leg actuator and folding center leg extended, Apr. 2000, 1 pg.

Photograph 8, Version 2, sofa shown at trade show in High Point, metal tube front leg with Version 2 of front leg actuator and folding center leg extended, Apr. 2000, 1 pg.

Photograph 9, Versions 1 and 2, tube assembly front pivot (offset & extended), Jan. 2000, 1 pg.

UDM Design News, p. 32, Jun. 2000, 1 pg.

English abstract of CN1271554, last viewed on Espacenet.com on Oct. 30, 2015, 1 pg.

English abstract of CN2043842, last viewed on Espacenet.com on Oct. 30, 2015, 1 pg.

English abstract of CN2222467, last viewed on Espacenet.com on Oct. 30, 2015, 1 pg.

English abstract of CN2060312, last viewed on Espacenet.com on Oct. 30, 2015, 1 pg.

Abstract of corresponding U.S. Pat. No. 3,868,733, to JP5091464, last viewed on Espacenet.com on Oct. 30, 2015, 1 pg.

Junhong Home Furnishing Co., Ltd., Folding Guest Ottoman (JH-CB 001), http://foldingbeds.en.made-in-china.com/productimage/noFxEUJDDTRQ-2f1j00TBmtEpaWWRgQ/China-Folding-Guest-Ottoman-Beds-JH-CB-001-.html, known at least as early as Jul. 23, 2015, 2 pgs.

Junhong Home Furnishing Co., Ltd., Folding Ottoman Sofa Storage Bed (JH-CB 007), http://foldingbeds.en.made-in-china.com/product/UbwxJrQvFTYE/China-Folding-Ottoman-Sofa-Storage-Bed-JH-CB-007-.html, known at least as early as Jul. 15, 2015, 2 pgs.

Leisure Lounge, Manufacturers of Fine Furniture, Sleeper Couches, http://leisurelounge.co.za/home/index.php/products/sleeper-couches, known at least as early as Jul. 15, 2015, 5 pgs.

(56) References Cited

OTHER PUBLICATIONS

Shopping Warehouse, Nova Furniture Group Magical Ottoman Sleeper with Red Cover, http://www.shoppingwarehouse.net/prod-502050.html?src=bing, known at least as early as Jul. 15, 2015, 2 pgs.

* cited by examiner

CONVERTIBLE FURNITURE

FIELD OF INVENTION

The present disclosure relates to furniture, particularly seating furniture. More particularly, the present disclosure relates to seating furniture that is convertible from a folded configuration to an unfolded configuration, where the unfolded configuration may be used as a bed.

BACKGROUND

Convertible furniture has long existed to provide multi-functionality and space saving design. Sleepers, furniture pieces that unfold to provide a bed, have been particularly popular. Sleepers have been developed with several unfolding patterns and configurations to result in virtually every commonly available bed size, from cot to California king. Sleepers have found homes in health care for overnight guests in a hospital room. They are commonly seen in hospitality settings, provided as an extra bed within a hotel room. Sleepers are also common in residential settings were a sleeper can be used to accommodate friends and family visiting for the night.

Early convertible sleepers were often uncomfortable in both their folded and unfolded positions. In general the bed mechanisms limited the design options of the furniture when folded, leading to suboptimal comfort and appearance. Likewise, the need to be folded limited the comfort of the furniture when unfolded. Mattresses used with sleepers were necessarily thin and failed to adequately compare to traditional sleeping surfaces. Users could often feel the support structure used under the mattress. The design of the motion mechanisms used within the furniture often led to exposed linkages or springs when unfolded, resulting in undesirable gaps, pinch points or hard edges around the perimeter of the mattress.

There continues to be a need for a furniture piece that provides a folded position that is comfortable and aesthetically pleasing, minimizing or eliminating the ability to outwardly discern the furniture's ability to convert to a bed. Simultaneously, the furniture piece should produce an unfolded bed position that is able to provide a comfortable sleeping surface while minimizing the appearance and accessibility of a motion mechanism.

SUMMARY

In some embodiments, the present disclosure includes furniture convertible between a seating position and a bed position. The furniture may include a frame including spaced apart arms, a first section having a closed position and an open position, where, in the closed position, the first section is substantially horizontal between the spaced apart arms, and a second section separately moveable from the first section. The second section is movable from a folded position, where the second section is stored substantially within the frame, to an unfolded position, where the second section is unfolded outside of the frame and disposed adjacent to the first section in the closed position, thus forming a horizontal sleeping surface.

The present disclosure includes furniture convertible between a seating position and a bed position according to other embodiments having a frame including spaced apart arms, and a first section movable between a closed position and an open position where, in the closed position, the first section is substantially horizontal and a top surface of the first section is substantially flush with a top surface of the arms. The furniture may also include a second section and a third section moveable from a folded position, where the second and third sections are stacked within the frame, to an unfolded position, where the second and third sections are aligned horizontally and disposed adjacent to the first section in the closed position, to form a horizontal sleeping surface.

Furniture convertible between a seating position and a bed position is also described with a frame including spaced apart arms, each arm having a cavity between a side wall and an inner face thereof. The furniture may also include a first section pivotable between a closed position and an open position where, in the closed position, the first section is substantially horizontal, and where, in the open position, the first section is substantially upright. The furniture may have a first pivot assembly located substantially within the cavity for attaching the first section to the side wall. At least a second section pivotable from a folded position within the frame to an unfolded position at least partially outside of the frame may be part of the furniture, where the unfolded position is a horizontal position disposed adjacent to the first section in the closed position, to form a horizontal sleeping surface. The furniture may also have and a second pivot assembly located substantially within the cavity for attaching the second section to the side wall, where there are substantially no gaps between the sides of the first section and the inner face of the arms when the first section is in the closed position.

Another embodiment includes furniture convertible between a seating position and a bed position that comprises a frame including spaced apart arms and at least two movable sections disposed between the arms in the seating position. A motion mechanism is included that is configured to allow the at least two movable sections to convert between the seating position and the bed position. All upholstered components are connected and non-removable from the furniture. A first section of the at least two sections is moved while converting from the seating position to the bed position, but is in the same position in the seating position as in the bed position. Further, there is substantially no gap between the arms and the first section in either the seating position or the bed position.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
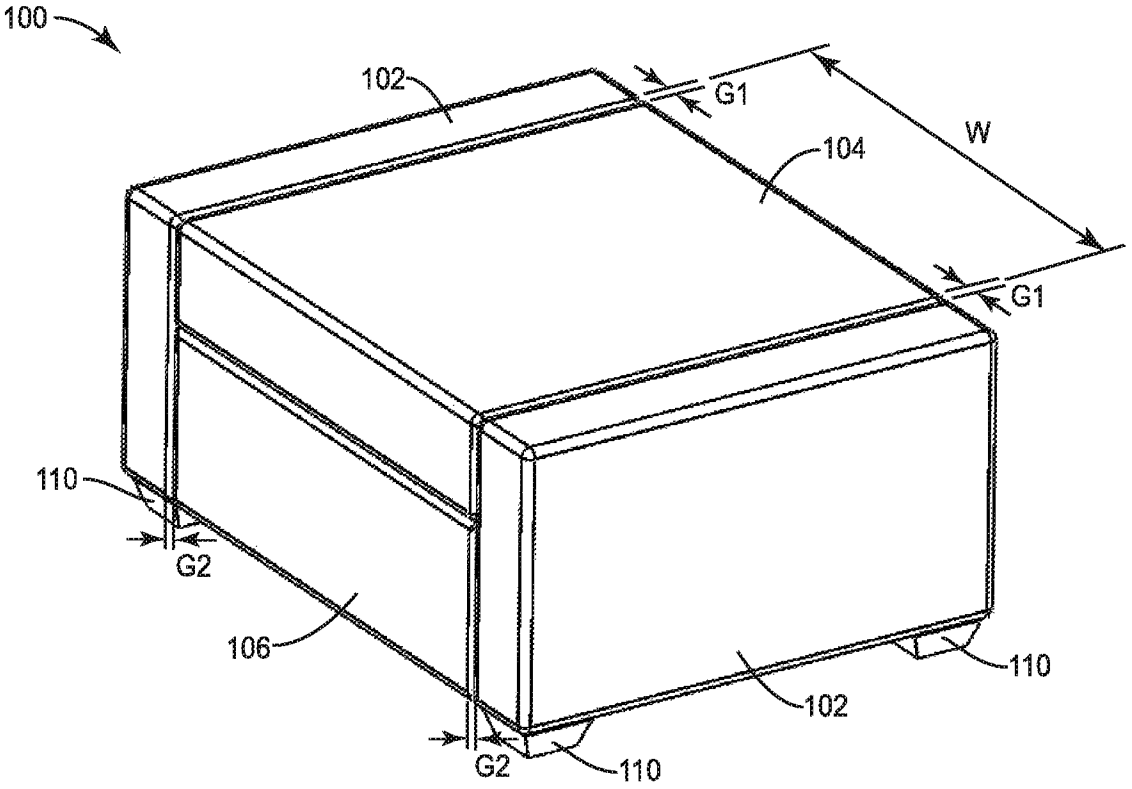
FIG. 1 is a perspective view of furniture in a seating position according to an embodiment of the present disclosure.

FIG. 1 is a front perspective view of a convertible furniture piece, referred to herein as seat 100, in a seating position according to an embodiment of the present disclosure. The illustrated embodiment shows the seat 100 as an ottoman. Ottomans are often provided as foot rests adjacent to other seats such as sofas or chairs. Ottomans may be used for sitting directly on the top thereof. Therefore an ottoman would be considered a seat as used herein. As used herein the term "seat" should be broadly constructed to include soft-topped tables, sometimes used instead of a traditional coffee table. The ottoman embodiment shown in FIG. 1 may be described as backless, i.e. lacking a backrest in the seating position. Seats 100 of the present disclosure are not limited to such backless designs but may also include chairs or sofas with backrests provided when used in the seating position.

In the illustrated embodiment, the seat 100 is designed with a "tight," finished appearance due to upholstered surfaces visible from each generally accessible direction. In one embodiment, all upholstered components are connected and irremovable from the seat 100. In comparison, similar sleeper ottomans of the prior art are constructed with a slip cover merely draped over a folding bed frame, requiring the slip cover to be removed prior to unfolding the prior art products into a bed. A slip cover could be fit over the seat 100 of the present disclosure, but such a slip cover is not expected to be necessary to provide a finished look to the furniture.

As seen in FIG. 1, the seat 100 may include arms 102, a top cushion 104, and a front cross member 106, all of which are preferably upholstered. A rear cross member 108 (FIG. 2) is also provided. The arms 102 and the cross members 106, 108 may be supported off the ground by a set of feet 110. The width W, i.e. the inside spaced-apart distance between the arms 102, may vary, but should substantially correspond to the width of a bed being unfolded from the seat 100. In the example of a cot-size bed, W may be about 30 inches. In one example, the top surface of the arms 102 is substantially flush with the upper surface of the top cushion 104.

Figure 2:
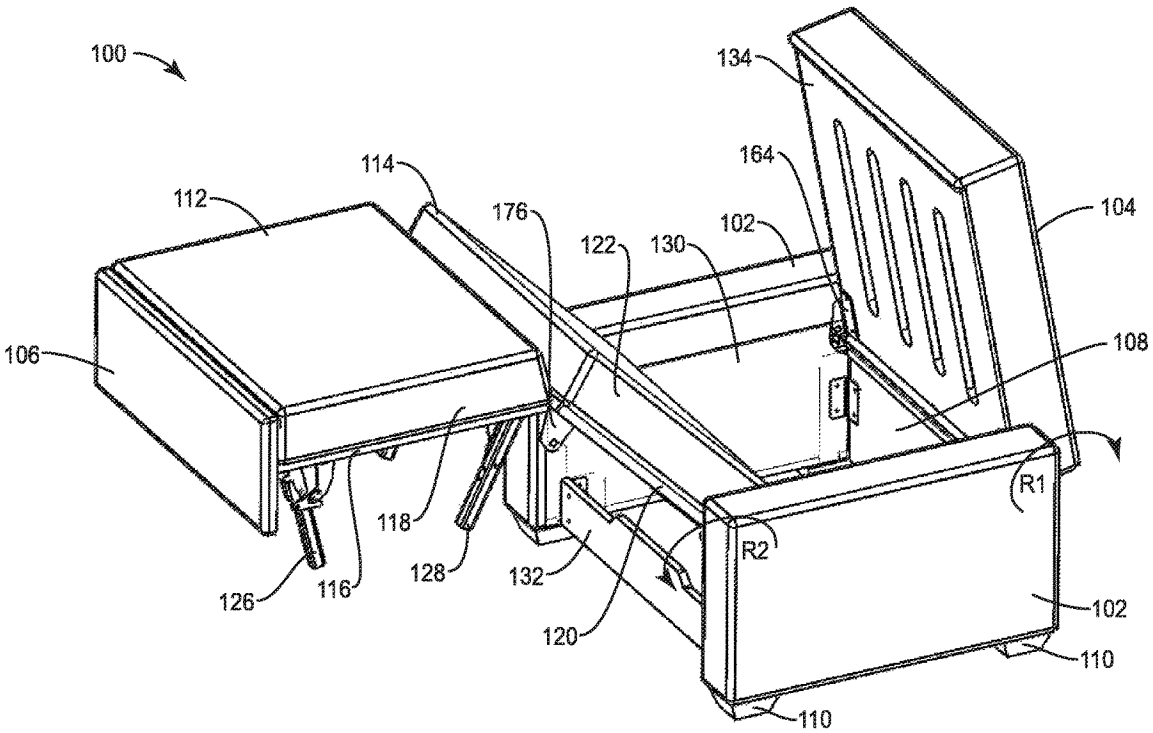
FIG. 2 is a perspective view of the furniture of FIG. 1 in a partially unfolded position.

FIG. 2 is a perspective view of the seat 100 in a partially open position, such that the unfolding sequence of the seat 100 may begin to be understood. The top cushion 104 has been rotated in the direction R1 from a substantially horizontal closed position in FIG. 1 to a generally upright open position as seen in FIG. 2. When the top cushion 104 is pivoted to the open position, in the present embodiment, access is provided to a foot section 112 and a middle section 114. To unfold the foot section 112 and the middle section 114, a user can pull upwardly and outwardly on the front cross member 106 with respect to the arms 102. In the illustrated embodiment, the seat 100 unfolds with two independent actions, moving the top cushion 104, and separately moving the bed portion having the foot section 112 and the middle section 114.

The foot section 112 may generally comprise a foot panel 116 attached to the bottom of a foot mattress 118. Therefore the foot section 112 would be facing upward when the foot mattress 118 is above the foot panel 116. The foot panel 116 may be formed from wood or other rigid supportive material. The foot panel 116 may be between about ½" and about 1" thick. The foot mattress 118 may have any known mattress material, such as coil springs, gels, memory foams, or combinations thereof. The foot mattress 118 may be between about 3" and about 6" thick to provide a comfortable sleeping surface. Similarly, the middle section 114 may include a middle panel 120 and a middle mattress 122 constructed similarly to the elements of the foot section 112.

In the folded position (FIG. 1), the middle section 114 may be stored generally horizontally and facing downwardly within the footprint of the arms 102. Unfolding the middle section 114 as shown in FIG. 2 may cause the middle section 114 to rotate in the direction R2 substantially through 180 degrees to an upright facing position ahead of the arms 102. The foot section 112 may be stored below the top cushion 104 in a generally horizontal, upward facing orientation relatively stacked above the middle section 114. As the foot section 112 is lifted and pulled from the folded position, a hinge 124 (FIG. 7) pivotably links the foot section 112 to the middle section 114 so that they may unfold as a pair.

The foot section 112 and the middle section 114 are supported by foot legs 126 and middle legs 128 respectively in the unfolded position. The process of folding and unfolding the foot section 112 and the middle section 114 concurrently facilitate the folding and unfolding of the foot legs 126 and the middle legs 128 from a substantially horizontal stored position substantially between the foot section 112 and the middle section 114 to their respective vertical unfolded positions. The operation of the middle legs 128 and the foot legs 126 may be done by any suitable mechanism that links the unfolding motion of the foot section 112 and the middle section 114 to the unfolding of the legs. A particularly suitable arrangement of the legs may be described by US Patent Publication US 2014/0101846, assigned to American Leather Operations, Dallas, Tex.

The arms 102, the rear cross member 108, and a front cross support 132 may be bolted or otherwise fixedly connected together to form a stationary frame for the seat 100. FIG. 2 shows an optional upholstery layer 130 may be provided along the inside of each arm 102 to conceal moving parts located behind the upholstery layer 130, such as portions of the top panel pivot assembly and the middle panel pivot assembly discussed below.

Figure 3:
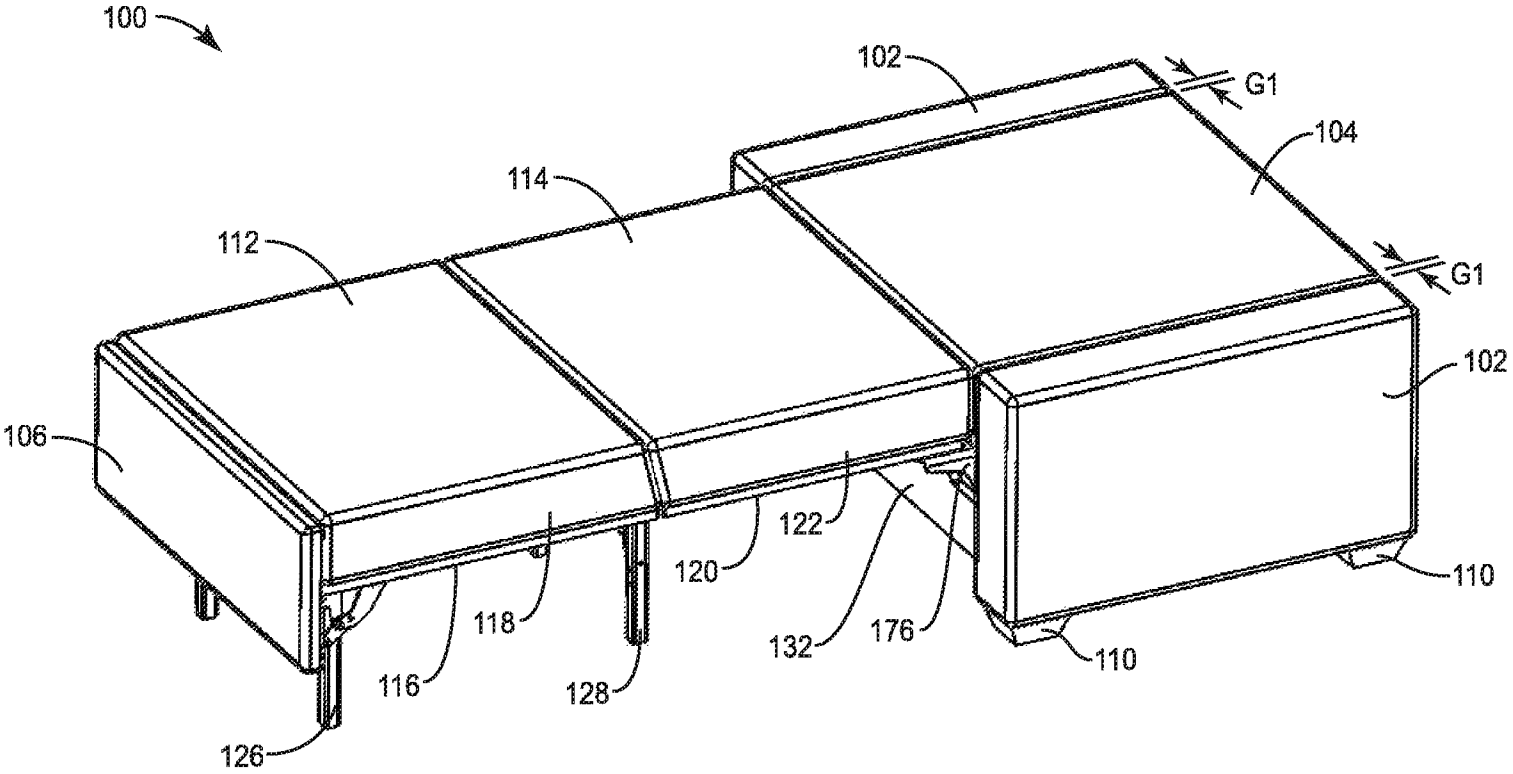
FIG. 3 is a perspective view of the furniture of FIG. 1 in a bed position.

FIG. 3 shows the seat 100 in the fully unfolded bed position. Flowing from FIG. 2 to FIG. 3, one skilled in the art will recognize that the foot section 112 and the middle section 114 have been fully unfolded to each achieve an upwardly facing horizontal position with the foot mattress 118 and the middle mattress 122 laid out in front of the frame of the seat 100. The top cushion 104, supported by a top panel 134 (FIG. 2) was rotated back from the upright open position to the horizontal closed position such that the top cushion 104 lies in close proximity to the middle mattress 122 to form a three-segment horizontal bedding surface.

As shown in FIG. 3, dimension G1 is the gap between the side of the top cushion 104 and the inside face of a respective arm 102. In some embodiments, the side of the upholstered top cushion 104 contacts the upholstery layer 130 or other upholstered portion of the arm 102 such that G1 is substantially zero when the top cushion 104 is in the closed position. A similar gap-free fit (G2, FIG. 1) is preferred between the inside of each arm 102 and the ends of upholstered front cross member 106. Accordingly, this allows the seat 100 to be attractive when used as a bed and to minimize the visibility of, and user contact with, portions of a motion mechanism of the seat.

Figure 4:
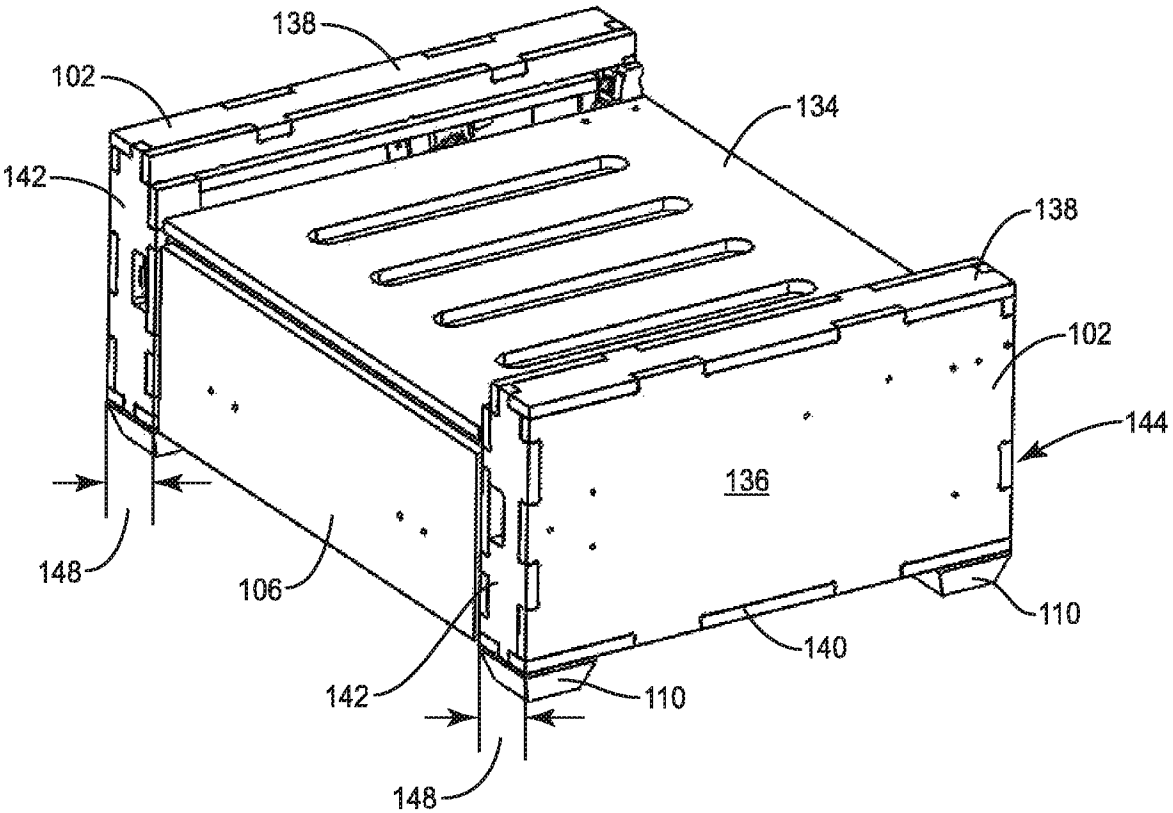
FIG. 4 shows the seating position of the furniture with the upholstery and cushions removed.
Figure 5:
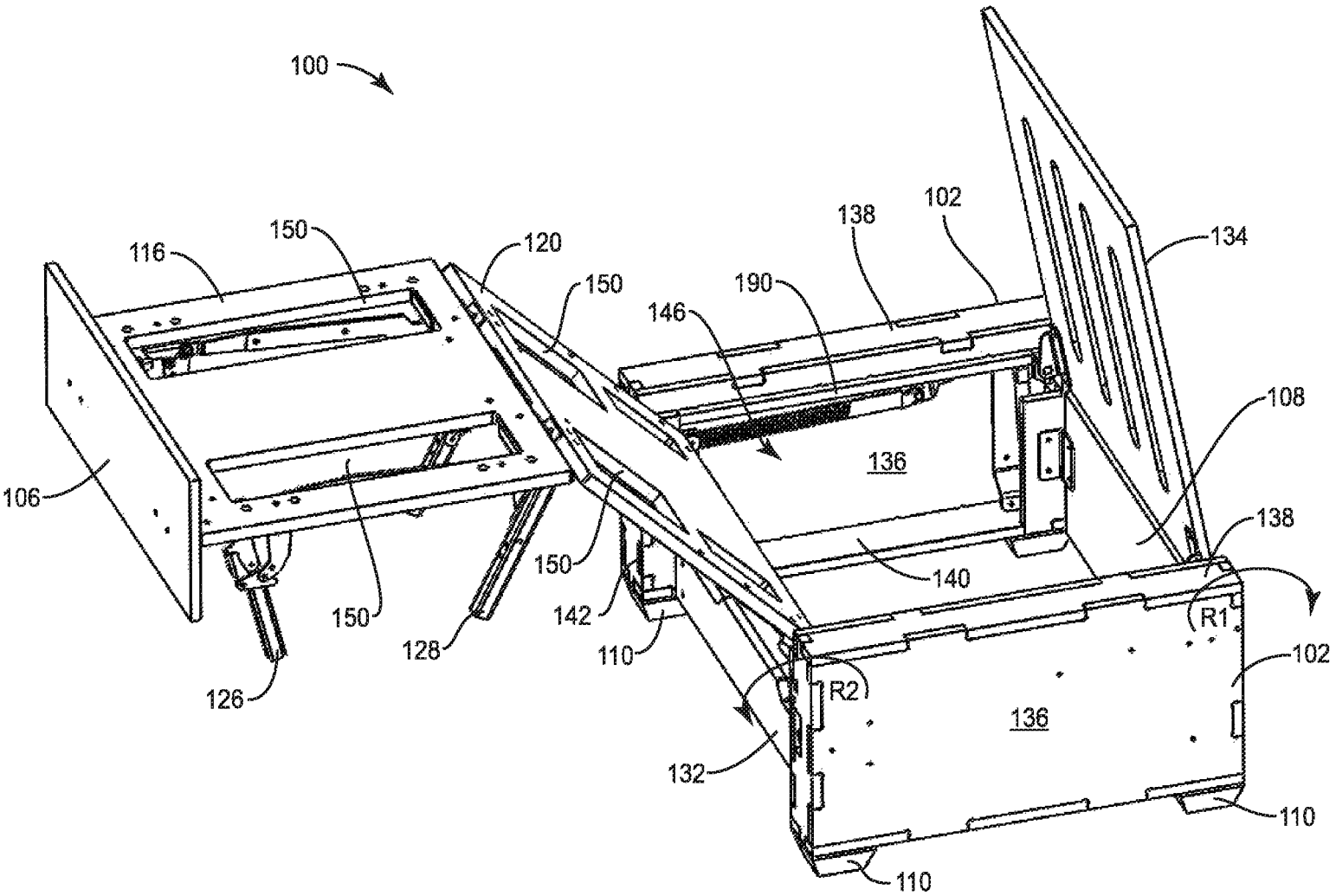
FIG. 5 shows the partially open position of the furniture with the upholstery and cushions removed.
Figure 6:
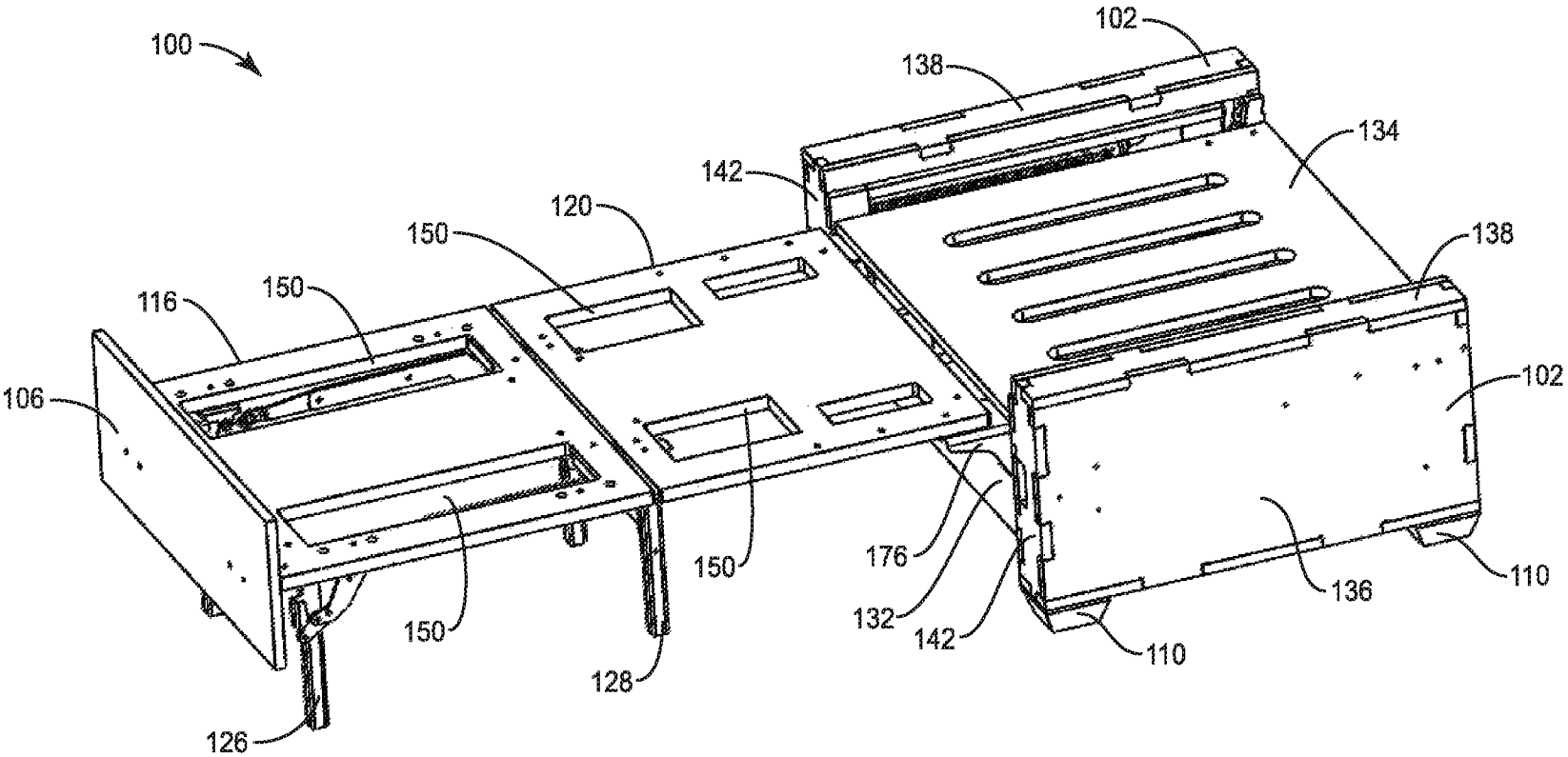
FIG. 6 shows the bed position of the furniture with the upholstery and cushions removed.

FIGS. 4-6, respectively, show the seat 100 in the seating position, the partially open position, and the bed position substantially similar to FIGS. 1-3. FIGS. 4-6, however, begin to show more of the inner workings of the seat 100 by omitting the upholstery and the cushion and mattress portions. Seen from FIGS. 4 and 5, each arm 102 may be constructed as an inwardly open box shape created from a side wall 136, a top wall 138, a bottom wall 140, a front wall 142 and a rear wall 144. The inwardly open box defines an arm cavity 146 (FIG. 5) with an arm thickness 148.

FIGS. 5 and 6 illustrate notches 150 of various sizes and shapes formed through the top panel 134, the foot panel 116 and the middle panel 120. The notches 150 into or through the foot panel 116 and the middle panel 120 may be particularly useful in accommodating portions of the foot legs 126, the middle legs 128 or linkages thereof, particularly in the folded, stored position.

Figure 7:
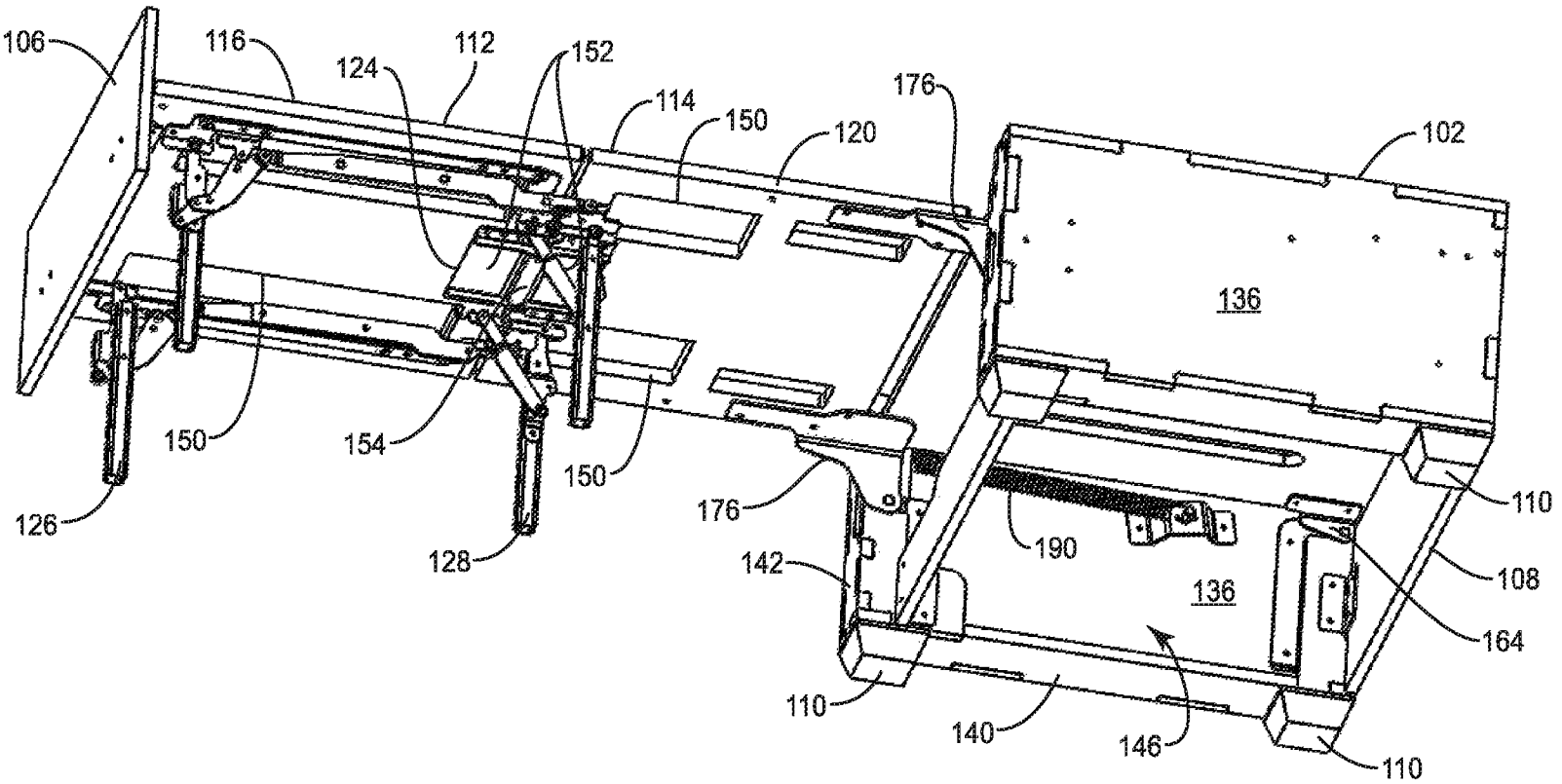
FIG. 7 is an underside view of the bed position shown in FIG. 6.

FIG. 7 shows an underside view of the un-upholstered seat 100 in the unfolded bed position. The hinge 124 is shown here. The hinge 124 may be a hinge having a pair of leaves 152 attached to the foot panel 116 and the middle panel 120 respectively. The hinge 124 may be arranged to provide a mandrel through the center of one or more torsion springs 154 so as to locate the center of the torsion spring 154 at and on the hinge line between the foot panel 116 and the middle panel 120. The torsion spring 154 may have opposing legs arranged to be substantially parallel and opposite each other in their related state and with such legs contacting the surfaces of the foot panel 116 and the middle panel 120 when the panels are in the bed position. Accordingly, when the foot panel 116 and the middle panel 120 are in the folded and closed position, the legs of the torsion spring 154 may have undergone a 180 degree rotation to impart a torque on the foot panel. Such a torque is expected to be sufficient to reduce the force necessary to lift the front of the foot panel 116 when moving the foot panel from the folded position to the bed position. In other words, the torsion spring 154 may be configured to bias the foot section 112 and the middle section 114 into the unfolded position. The number of torsion springs 154 used may vary based on the desired magnitude of force needed. The desired force is likely to depend upon the size of the seat 100. As a result, the user is given an assist when attempting to move the foot section 112 upwardly during the initial unfolding motion. Further, with the hinge 124 biasing toward the unfolded position, the hinge 124 helps control the motion in the folding direction as well, by providing a force opposing gravity as the foot section 112 seeks to collapse back into the folded position.

Figure 8:
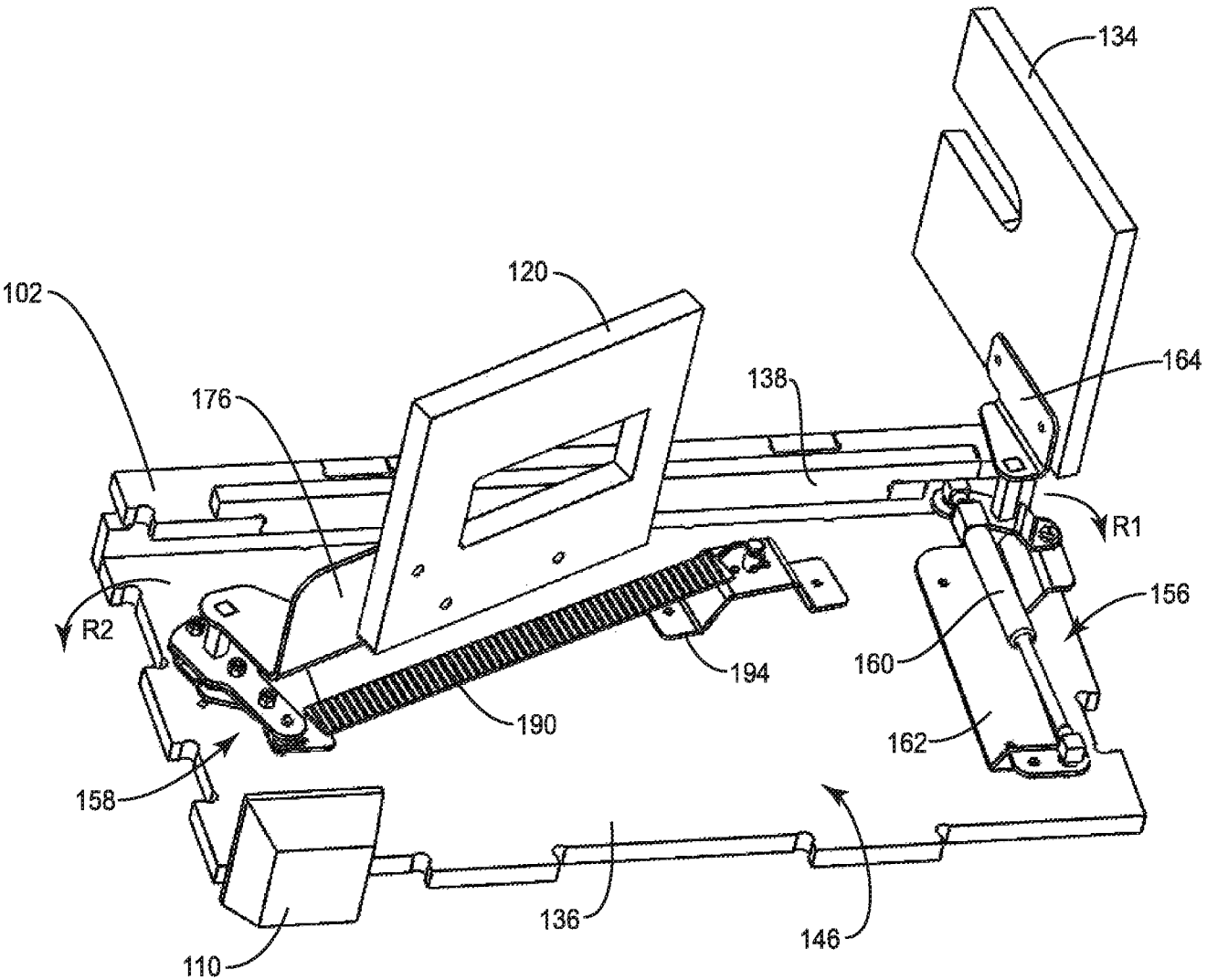
FIG. 8 is a detailed underside view of the inside of an arm of the furniture in a partially open position.

FIG. 8 is a detailed partial inside perspective view of an arm 102 with the top panel 134 in the open position and the middle panel 120 approaching the horizontal stored position. Shown are the side wall 136 and the top wall 138 partially defining the arm cavity 146. As will be more fully described, a top panel pivot assembly 156 and a middle panel pivot assembly 158 are configured to facilitate and assist motion of the top cushion 104 and the foot and middle sections 112 and 114 respectively.

Figure 9:
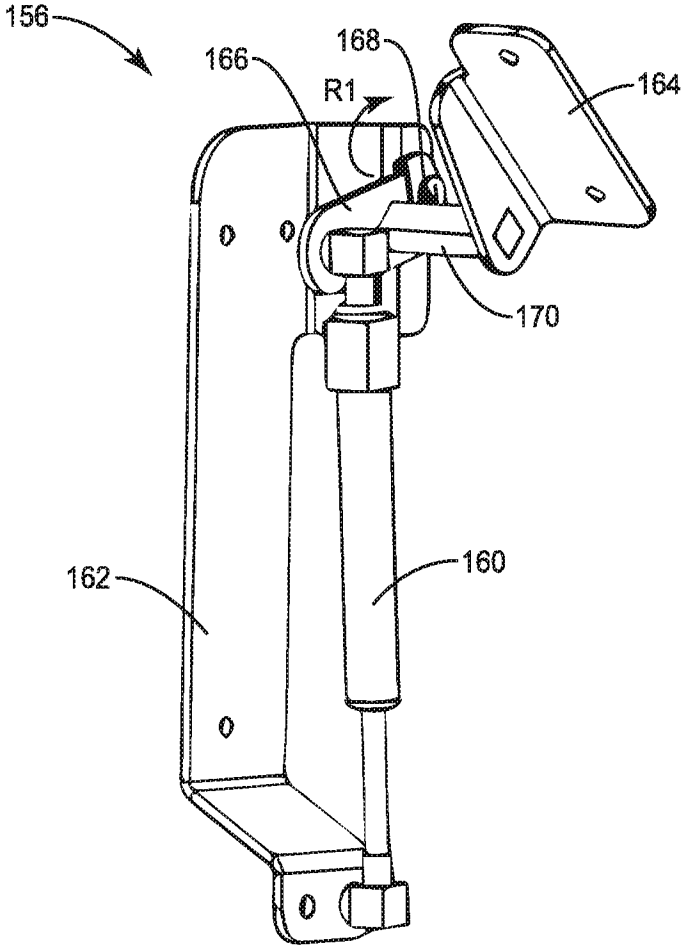
FIG. 9 shows a top panel pivot assembly in a partially open position.

FIG. 9 is a detailed view of the top panel pivot assembly 156 in a partially open position. The top panel pivot assembly 156 may include a gas cylinder 160. Generally it should be understood that the top panel may be supported by mirror symmetric top panel pivot assemblies 156 attached to the respective right and left arms. However, a gas cylinder 160 on only one side of the seat 100 may be sufficient to provide the desired motion control forces. The top panel pivot assembly 156 may include a mounting plate 162 bolted or otherwise attached to the side wall 136 of the arm 102 (FIG. 8). The top panel pivot assembly 156 may also include a support bracket 164 bolted or otherwise attached to the top panel 134 (FIG. 8). A pivot link 166 may be pivotally attached at one end to the mounting plate 162 at a first pivot point 168 and at its opposite end to the top of the gas cylinder 160. The pivot link 166 may be rotationally fixed to the support bracket 164 by a first offset bar 170. The first offset bar 170 may pass through the upholstery layer 130 (FIG. 2). The lower end of the gas cylinder 160 may be pivotally attached to a lower portion of the mounting plate 162.

As the top cushion is rotated open and closed about R1, the gas cylinder 160 is compressed during closing and expanded during opening. The maximum extension of the gas cylinder 160 may set the limit for the range of motion of the top cushion in its open position. The gas cylinder 160 may act similar to a compression spring to provide an upward expansion force creating a clockwise moment about the first pivot point 168 to counterbalance the weight of the top panel 134 so that the top panel may be raised to a fully open position with a small upward force. The gas cylinder 160 may be configured so that the maximum expansion thereof provides the opening limit for the top cushion 104. Likewise, the gas cylinder 160 can bias and hold the top panel 134 to its open position so that the user does not have to maintain hold of the top panel to maintain the open position. Put more generally, the gas cylinder 160 provides that, at all times, the movement of the top cushion is smooth, slow, and controlled. Springs or other biasing elements that provide similar resistance to motion as provided by the gas cylinder 160 may also be used. These elements may be collectively referred to as motion controllers. In some embodiments, the top cushion is allowed to rotate without any motion controllers. In other embodiments, the motion controllers may be powered to operate the top panel pivot assembly 156 with a button. Powered actuators are known in the art.

Figure 10:
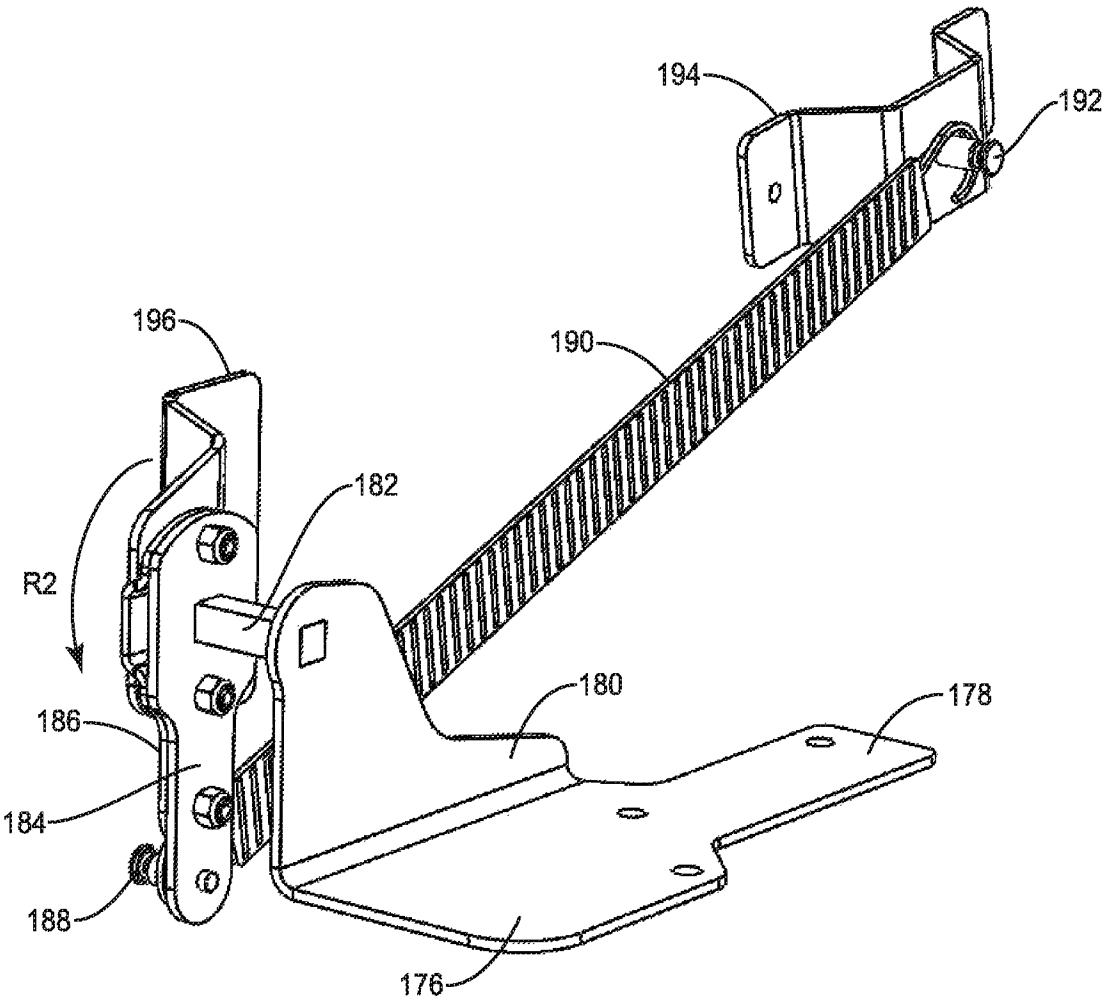
FIG. 10 shows a middle panel pivot assembly in the seating position.

FIG. 10 is a detailed view of the middle panel pivot assembly 158 in the folded position. The middle panel pivot assembly 158 may include a bed support bracket 176 bolted or otherwise attached to the middle panel 120. The bed support bracket 176 may include an attachment flange 178 and a projecting flange 180. The vertically projecting flange 180 may be rotationally fixed to a second offset bar 182 that may project outward perpendicular to such vertically projecting flange 180. The opposite end of the second offset bar 182 may be fixed to a spring arm 184. The spring arm 184 is substantially parallel to the vertical projecting flange 180. The spring arm 184 may be bolted or otherwise rotationally fixed to a pivot plate 186. The spring arm 184, or a spring post 188 attached thereto may contact a portion of the arm in the folded position shown in FIG. 10 to act as a stop. Other alternative stop pins may be provided to limit relative motion of the spring arm 184 as the middle panel 120 is folded and unfolded.

The spring post 188 may be attached to one end of the spring arm 184 such that an extension spring 190 can be attached to the outward facing side of the spring arm 184. The other end of the extension spring 190 is attached to a spring pin 192. The spring pin 192 may be fixed to an innermost face of a first anchor plate 194, the first anchor plate 194 being bolted or otherwise fixed to the side wall 136 of the arm 102. Accordingly, the extension spring 190 extends and contracts in a space between the innermost face of the first anchor plate 194 and the outermost face of the spring arm 184 defined by planes substantially parallel to the side wall 136. The pivot plate 186 is pivotally attached to a second anchor plate 196 at second pivot point (not shown). The second anchor plate 196 is bolted or otherwise attached to an inner face of the side wall 136 of the arm 102. This arrangement allows spring arm 184 to pivot 180 degrees from a substantially downward projecting position when the middle panel is in its folded position to a substantially upward position when the middle panel is in its unfolded bed position about R2. Accordingly, extension spring 190 minimizes the downward force of the middle panel both during folding and unfolding. In other words, because the extension spring 190 is in a relatively stretched position when the middle panel is folded, during unfolding, the extension spring seeks to contract, assisting with the desired counterclockwise motion from the perspective of FIG. 10 about R2. During folding, especially after the middle section closes past vertical, gravity will act to fold the middle section into the frame. The extension spring 190 will be stretched during the last portion of the folding motion to achieve the relatively stretched position of the extension spring when the middle panel is folded. Stretching the extension spring 190 creates a resistance force to slow motion of the middle section and prevent the middle section from slamming back into the folded position.

Figure 11:
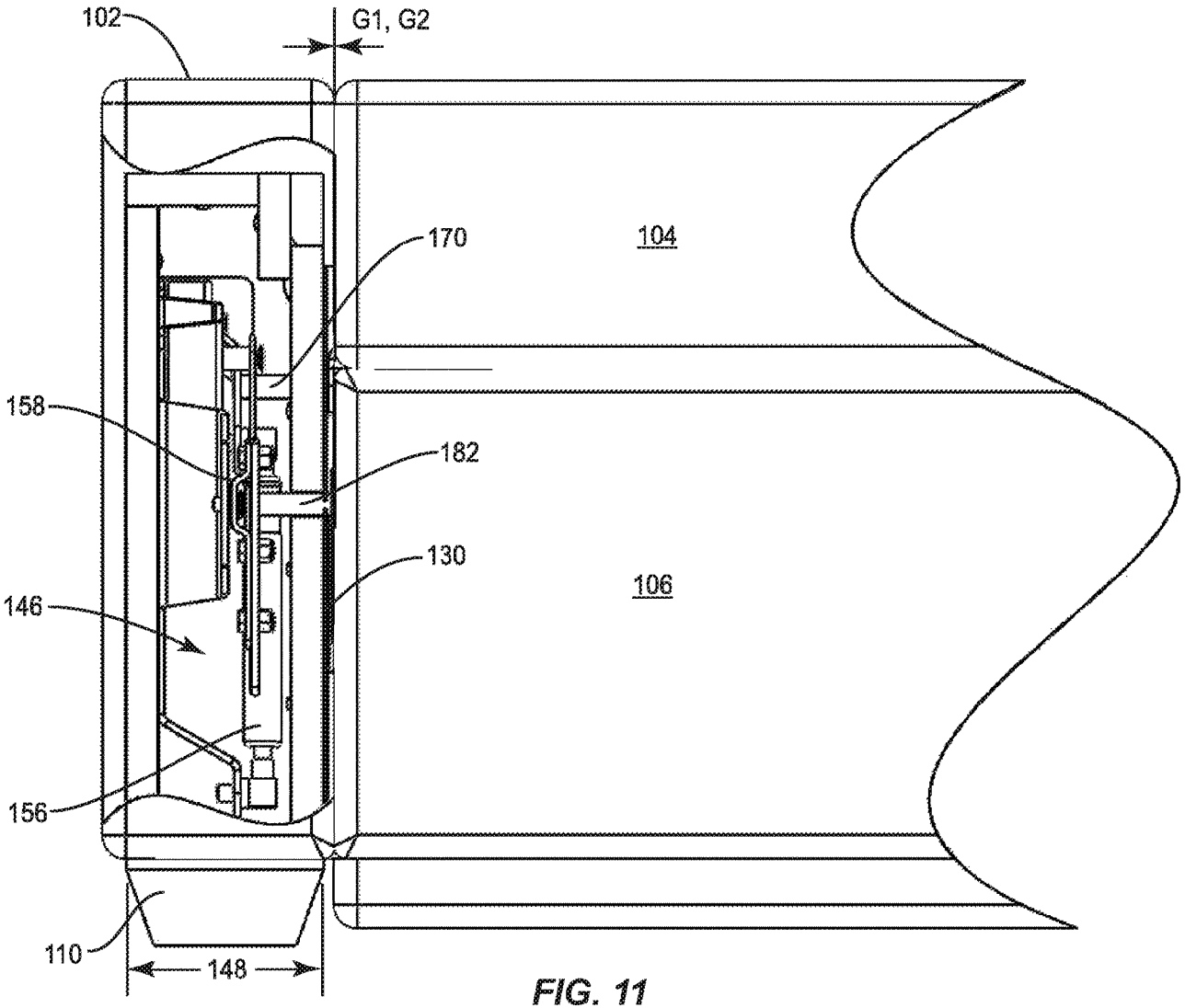
FIG. 11 is a cut away view of an arm of the furniture in the seating position.
Figure 12:
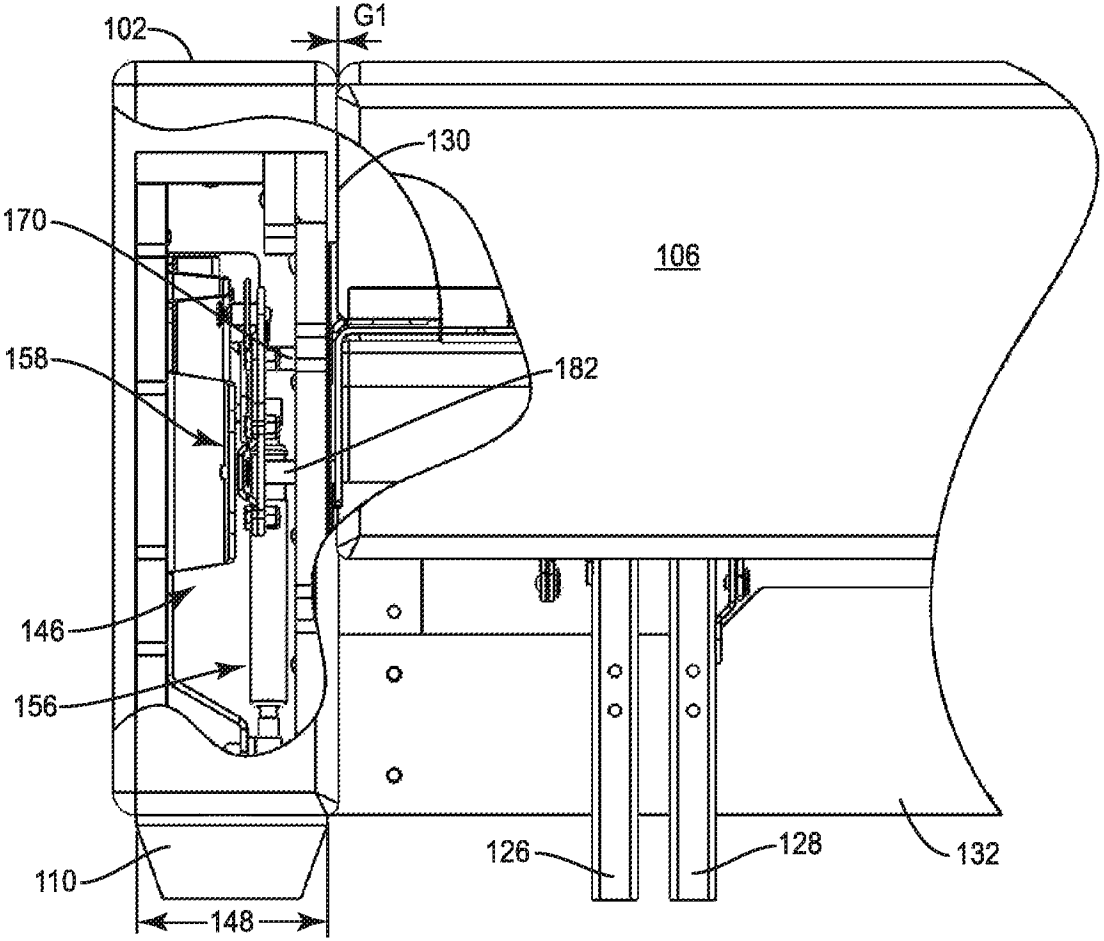
FIG. 12 is a cut away view of the arm of the furniture in the bed position.

FIGS. 11 and 12 show a cutaway front view of the left side of the seat 100 in the seating and bed positions respectively. These figures illustrate the packaging of the top panel pivot assembly 156 and a middle panel pivot assembly 158 within the arm cavity 146 such that only the first offset bar 170 and second offset bar 182 protrude from the arm cavity 146 between the upholstery layer 130 and the middle section 114 such that the gaps G1, G2 are substantially zero. In other words, the top panel pivot assembly 156 and a middle panel pivot assembly 158 operate in the thickness of the arms 102 and are able to remain substantially hidden. There are aesthetic and safety benefits of having these pivot assemblies hidden and operating behind an upholstery layer 130 on the inside of the arm 102.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. Furniture convertible between a seating position and a bed position, comprising:

a frame including spaced apart arms;

a first section having a closed position and an open position, where, in the closed position, the first section is substantially horizontal between the spaced apart arms; and a second section separately moveable from the first section, the second section being movable from a folded position, where the second section is stored substantially within the frame, to an unfolded position, where the second section is unfolded outside of the frame and disposed adjacent to the first section in the closed position, to form a horizontal sleeping surface.

2. The furniture of claim 1, further comprising a third section moveable with the second section from the folded position to the unfolded position to be disposed adjacent to the second section in the unfolded position, to form the horizontal sleeping surface.

3. The furniture of claim 2, wherein, in the folded position, each of the second and third sections are substantially horizontal, and are stacked relative to one another.

4. The furniture of claim 3, wherein, in the folded position the second section faces downward and the third section is on top of the second section, the third section facing upward.

5. The furniture of claim 2, wherein the second section is hinged to the third section with a torsion spring.

6. The furniture of claim 1, wherein the first section and the second section each comprise a support panel and a cushion.

7. The furniture of claim 6, wherein a top surface of the cushion of the first section is substantially flush with a top surface of the arms when the first section is in the closed position.

8. The furniture of claim 1, wherein the first section is pivotably joined to the arms by at least one first pivot assembly to pivot the first section from the closed position to the open position, which is substantially upright, and the second section is pivotably joined to the arms by at least one second pivot assembly.

9. The furniture of claim 8, wherein each arm comprises a cavity between a side wall and an inner face of each arm; and the first pivot assembly and the second pivot assembly mount to the side wall of each arm such that the first pivot assembly and the second pivot assembly are positioned substantially within the cavity of each arm, and there are substantially no gaps between the sides of the first panel and the inner face of the arms when the first panel is in the closed position.

10. The furniture of claim 9, wherein the inner face of each arm is closed by an upholstery layer having apertures for an offset bar of the first pivot assembly and the second pivot assembly respectively.

11. The furniture of claim 8, wherein the at least one first pivot assembly includes a motion controller.

12. The furniture of claim 11, wherein the motion controller is a gas cylinder.

13. The furniture of claim 8, wherein the at least one second pivot assembly includes a spring to assist unfolding of the second section and to slow the folding of the second section.

14. The furniture of claim 1, wherein the seating position provides an ottoman.

15. Furniture convertible between a seating position and a bed position, comprising:

a frame including spaced apart arms;

a first section movable between a closed position and an open position where, in the closed position, the first section is substantially horizontal and a top surface of the first section is substantially flush with a top surface of the arms; and a second section and a third section moveable from a folded position where the second and third sections are stacked within the frame, to an unfolded position, where the second and third sections are aligned horizontally and disposed adjacent to the first section in the closed position, to form a horizontal sleeping surface.

16. The furniture of claim 15, wherein the first section is pivotably joined to the arms by at least one first pivot assembly to pivot the first section from the closed position to the open position, which is substantially upright, and the second section is pivotably joined to the arms by at least one second pivot assembly.

17. The furniture of claim 16, wherein each arm comprises a cavity between a side wall and an inner face of each arm; and the first pivot assembly and the second pivot assembly mount to the side wall of each arm such that the first pivot assembly and the second pivot assembly are positioned substantially within the cavity of each arm, and there are substantially no gaps between the sides of the first panel and the inner face of the arms when the first panel is in the closed position.

18. Furniture convertible between a seating position and a bed position, comprising:

a frame including spaced apart arms, each arm having a cavity between a side wall and an inner face thereof;

a first section pivotable between a closed position and an open position where, in the closed position, the first section is substantially horizontal, and where, in the open position, the first section is substantially upright;

a first pivot assembly located substantially within the cavity for attaching the first section to the side wall;

at least a second section pivotable from a folded position within the frame to an unfolded position at least partially outside of the frame, wherein the unfolded position is a horizontal position disposed adjacent to the first section in the closed position, to form a horizontal sleeping surface; and a second pivot assembly located substantially within the cavity for attaching the second section to the side wall, wherein there are substantially no gaps between the sides of the first section and the inner face of the arms when the first section is in the closed position.

19. The furniture of claim 18 further comprising an upholstery layer along the inner face of each arm to hide at least a portion of the first pivot assembly and the second pivot assembly.

20. The furniture of claim 18, wherein the first section and the second section each comprise a support panel and a cushion, wherein a top surface of the cushion of the first section is substantially flush with a top surface of the arms when the first section is in the closed position.

21. Furniture convertible between a seating position and a bed position, comprising:

a frame including spaced apart arms;

at least two movable sections disposed between the arms in the seating position;

a motion mechanism configured to allow the at least two movable sections to convert between the seating position and the bed position, wherein the frame and at least one of the movable sections are upholstered, and connected and non-removable from the furniture, wherein a first section of the at least two sections is moved while converting from the seating position to the bed position, but is in the same position in the seating position as in the bed position, and wherein there is substantially no gap between the arms and the first section in either the seating position or the bed position.

* * * * *